US009602899B2

(12) United States Patent
Li

(10) Patent No.: US 9,602,899 B2
(45) Date of Patent: Mar. 21, 2017

(54) SPEAKER AND ITS PRODUCTION METHOD

(75) Inventor: Shengbo Li, Guangdong (CN)

(73) Assignees: Harman International (China) Holdings Co., Ltd., Guangdong (CN); Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/399,441

(22) PCT Filed: May 8, 2012

(86) PCT No.: PCT/CN2012/075166

§ 371 (c)(1),
(2), (4) Date: Nov. 6, 2014

(87) PCT Pub. No.: WO2013/166648

PCT Pub. Date: Nov. 14, 2013

(65) Prior Publication Data

US 2015/0156572 A1 Jun. 4, 2015

(51) Int. Cl.

| | |
|---|---|
| ***H04R 25/00*** | (2006.01) |
| ***H04R 1/02*** | (2006.01) |
| ***H04R 1/28*** | (2006.01) |
| ***H04R 31/00*** | (2006.01) |

(52) U.S. Cl.

CPC ..... *H04R 1/02* (2013.01); *H04R 1/28* (2013.01); *H04R 1/283* (2013.01); *H04R 31/006* (2013.01); *H04R 2231/003* (2013.01); *H04R 2499/13* (2013.01); *Y10T 29/4957* (2015.01)

(58) Field of Classification Search

CPC .... H04R 1/227; H04R 1/2834; H04R 1/2896; H04R 1/283

USPC ..... 381/386, 335, 87, 349, 346, 347, 348, 381/353, 354

See application file for complete search history.

(56) References Cited

U.S. PATENT DOCUMENTS

| | | | |
|---|---|---|---|
| 7,158,648 | B2 | 1/2007 | Butters et al. |
| 2010/0027815 | A1 | 2/2010 | Burge |
| 2012/0114148 | A1 | 5/2012 | Goh Kong San et al. |

FOREIGN PATENT DOCUMENTS

| | | | |
|---|---|---|---|
| CN | 101600131 | A | 12/2009 |
| CN | 201854402 | U | 6/2011 |
| CN | 102428713 | A | 4/2012 |

(Continued)

OTHER PUBLICATIONS

International Search Report and Written Opinion for corresponding Application No. PCT/CN2012/075166, mailed Feb. 14, 2013, 10 pages.

(Continued)

*Primary Examiner* — Davetta W Goins
*Assistant Examiner* — Phylesha Dabney
(74) *Attorney, Agent, or Firm* — Brooks Kushman P.C.

(57) ABSTRACT

A speaker and a method of producing a speaker, the speaker including: an enclosure; at least one transducer mounted in the enclosure; and at least one passive radiator mounted in the enclosure, including a suspension and a center panel encircled by and adhered to the suspension, wherein the at least one transducer is combined with the at least one passive radiator, and functions as at least a part of the center panel. According to the speaker of the present disclosure, by fully or partly replacing the center panel of the at least one passive radiator by one or more transducer(s), both the internal space and the cost of the speaker are saved without sacrificing the sound quality.

12 Claims, 5 Drawing Sheets

(56) References Cited

FOREIGN PATENT DOCUMENTS

WO 2012051217 A2 4/2012

OTHER PUBLICATIONS

Chinese Office Action for Application No. 201280073009.4, dated Dec. 29, 2016, 7 pages.

SPEAKER AND ITS PRODUCTION METHOD

CROSS-REFERENCE TO RELATED APPLICATION

This application is the U.S. national phase of PCT Application No. PCT/CN2012/075166 filed on 8 May 2012, the disclosure of which is incorporated in its entirety by reference herein.

TECHNICAL FIELD

The present disclosure relates to the field of speaker with a passive radiator and its production method.

BACKGROUND

Nowadays, small speakers are broadly applied in many cases such as on-vehicle acoustic systems where there is no much space to accommodate large speakers. A passive radiator is generally used in a speaker to augment the bass performance, by tuning the design parameters correctly. When used properly, a passive radiator can give to a speaker with the comparable performance characteristics of a large speaker in which a "bass-reflex" port tube is used to augment the bass performance.

FIG. 1*a* is a cross-sectional side view of a typical speaker with a passive radiator included therein. As shown in FIG. 1*a*, the speaker 1 includes an enclosure 11, a transducer 12 and a passive radiator 13. Both the transducer 12 and the passive radiator 13 are mounted in the enclosure 11. Note that, the term "transducer" may also be referred to as "speaker driver" which is an active device for converting electricity into sound. A passive radiator looks like a normal transducer from the front. But, as suggested by its name, a passive radiator is a reactionary device and does not include a voice coil, a magnet and electronic structure attached to it, all of which are usually included in a normal transducer as well known in the art.

Specifically, the sound generated by the transducer 12 affects the internal air pressure of the enclosure 11, and the internal air pressure fluctuation caused by the transducer 12 in turn causes the passive radiator 13 to begin moving forward/backward so as to create sound frequencies as if it was also a transducer. Accordingly, by tuning properly, the passive radiator 13 can increase low frequency response (bass) of the speaker 1.

FIG. 1*b* further shows the correspondence between the cross-sectional side and front views of the passive radiator 13 in FIG. 1*a*. In FIG. 1*b*, the cross-sectional side view of the passive radiator 13 which is similar to that of FIG. 1*a* is shown on the upper side and the cross-sectional front view thereof is shown on the lower side. As shown in FIG. 1*b*, the passive radiator 13 includes a suspension 131 and a center panel 132 encircled by and adhered to the suspension 131. The suspension 131 provides the compliance, that is, ensures the center panel 132 vibrates in the axial direction of the passive radiator 13 but does not in the radial direction thereof. The center panel 132 provides the acoustic mass for the passive radiator 13 to work properly. The suspension 131 may be made of a soft and flexible material such as rubber, and the center panel 132 may be made of a hard material such as metal. Note that, although the center panel 132 is planar as shown in FIGS. 1*a* and 1*b*, it is only for the exemplary purpose and it may be of any other shapes, for example coned like the transducer 12.

However, as the miniaturization of speaker develops, the enclosure of speaker may not accommodate both a transducer and a passive radiator, which needs to be resolved.

SUMMARY OF THE DISCLOSURE

In one aspect of the present disclosure, there is provided a speaker, comprising: an enclosure; at least one transducer mounted in the enclosure; and at least one passive radiator mounted in the enclosure, comprising a suspension and a center panel encircled by and connected to the suspension, wherein the at least one transducer is combined with the at least one passive radiator, and functions as at least a part of the center panel.

In another aspect of the present disclosure, there is provided a speaker, comprising: an enclosure; at least one passive radiator mounted in the enclosure, each of the at least one passive radiator comprising a suspension; and at least one transducer combined with the at least one passive radiator in a way of being connected to and encircled by the suspension.

In another aspect of the present disclosure, there is provided a method of producing a speaker, comprising steps of: providing an enclosure; and mounting at least one transducer combined with at least one passive radiator in the enclosure, wherein the at least one passive radiator comprises a suspension and a center panel connected with and encircled by the suspension, and the at least one transducer functions as at least a part of the center panel.

In another aspect of the present disclosure, there is provided a method of producing a speaker, comprising steps of: providing an enclosure; mounting at least one transducer combined with at least one passive radiator in the enclosure, wherein each of the at least one passive radiator comprises a suspension, and the at least one transducer is connected with and encircled by the suspension.

According to the speaker and the production method of the present disclosure, by fully or partly replacing the center panel of the at least one passive radiator by one or more transducer(s), both the internal space and the cost of the speaker are saved without sacrificing the sound quality.

The foregoing is a summary and thus contains, by necessity, simplifications, generalization, and omissions of details; consequently, those skilled in the art will appreciate that the summary is illustrative only and is not intended to be in any way limiting. Other aspects, features, and advantages of the devices and/or processes and/or other subject matters described herein will become apparent in the teachings set forth herein. The summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1A:
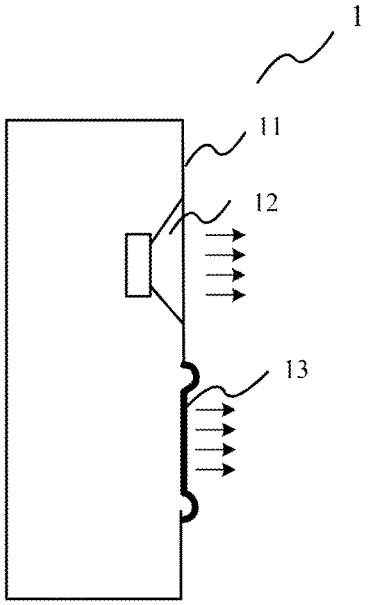
Fig. 1a Prior Art
FIG. 1*a* shows a cross-sectional side view of a typical speaker with a passive radiator.

In the following detailed description, reference is made to the accompanying drawings, which form a part hereof. In the drawings, similar symbols typically identify similar components, unless context dictates otherwise. It will be readily understood that the aspects of the present disclosure can be arranged, substituted, combined, and designed in a wide variety of different configurations, all of which are explicitly contemplated and make part of this disclosure.

Figure 2A:
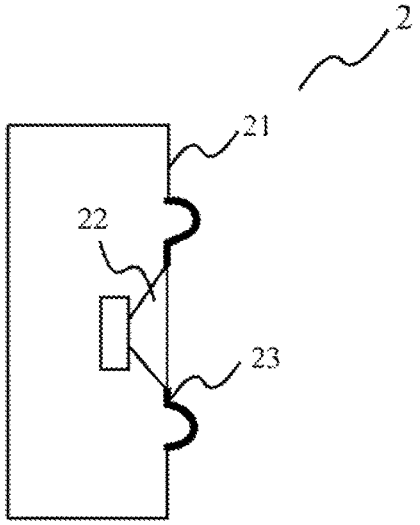
FIG. 2*a* shows a cross-sectional side view of a speaker according to an embodiment of the present disclosure.

FIG. 2*a* shows a cross-sectional side view of a speaker according to an embodiment of the present disclosure. As shown in FIG. 2*a*, similarly with the speaker 1 shown in FIG. 1*a* as described above, the speaker 2 includes an enclosure 21, a transducer 22 and a passive radiator 23. Both the transducer 22 and the passive radiator 23 are mounted in the enclosure 21. However, differently from the conventional speaker design, in the speaker 2 of the embodiment of the present disclosure, the transducer 22 and the passive radiator 23 are combined together instead of being separated from each other. According to one embodiment, the transducer 22 is mounted on the passive radiator 23 in a way of locating within the enclosure 21. Specifically, as shown in FIG. 2*a*, the transducer 22 partly replaces the center panel of the passive radiator 23.

Figure 1B:
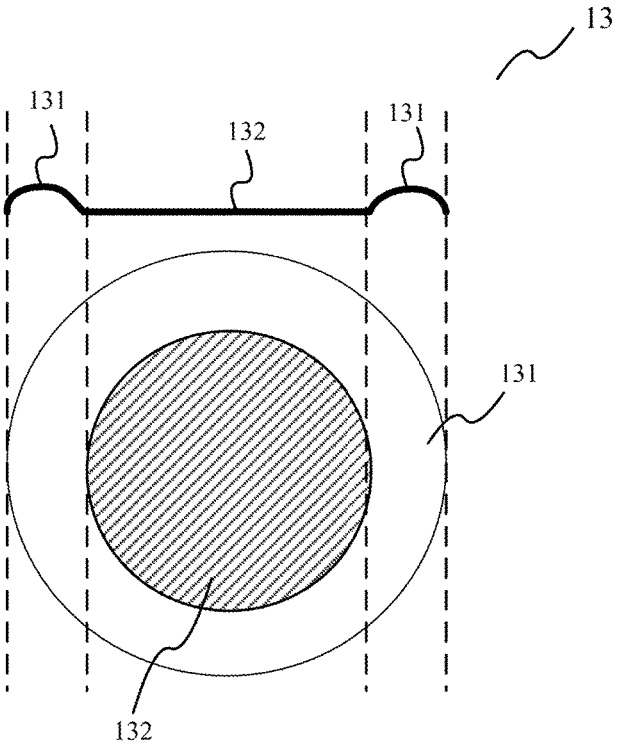
Fig. 1b Prior Art
FIG. 1*b* further shows the correspondence between the cross-sectional side view and the cross-sectional front view of the passive radiator in FIG. 1*a;*
Figure 2B:
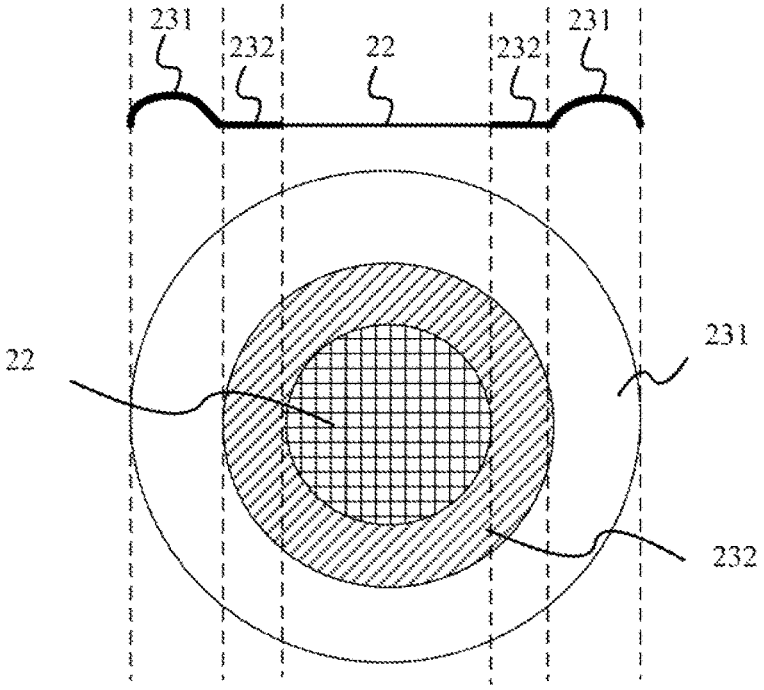
FIG. 2*b* further shows the correspondence between the cross-sectional side view and the cross-sectional front view of the passive radiator combined with the transducer in FIG. 2*a;*

FIG. 2*b* further shows the correspondence between the cross-sectional side view and the cross-sectional front view of the passive radiator 23 combined with the transducer 22 in FIG. 2*a*. In the embodiment, similarly with the case in FIG. 1*b*, the passive radiator 23 includes a suspension 231 and a center panel 232 encircled by and adhered to the suspension 231. However, the center panel 232 in FIG. 2*b* is ring-shaped instead of a full disk. The central disk denoted by grid lines in FIG. 2*b* indicates the transducer 22. By comparing FIG. 1*b* with FIG. 2*b*, it is not difficult to find that a part, i.e. the central disk denoted by grid lines, of the center panel of the passive radiator 23 is replaced by the transducer 22 in the embodiment of the present disclosure.

The transducer 22 is encircled by and adhered to the ring-shaped center panel 232. In this way, when operating, the transducer 22 vibrates together with the whole passive radiator 23. As described above, a center panel plays a role in providing the acoustic mass in a passive radiator. In the speaker design as shown in FIGS. 2*a* and 2*b*, while producing sound, the transducer 22 can also work as the acoustic mass of the passive radiator 23 by partly replacing the center panel 232 of the passive radiator 23. Accordingly, the internal space of the enclosure 21 is saved by combining the transducer 22 with the passive radiator 23. Therefore, the speaker is further miniaturized without sacrificing the sound quality. Further, by replacing a part of center panel 232 of the passive radiator 23 by the transducer 22, the material for making the center panel 232 is reduced and thus the cost is saved.

It is noted that, although the transducer 22 is described above as being combined with the passive radiator 23 by adhering, the way of combination is not limited thereto and the two devices may be combined with each other by any known techniques in the art, such as by riveting, crimping, bolting or the like.

Figure 2C:
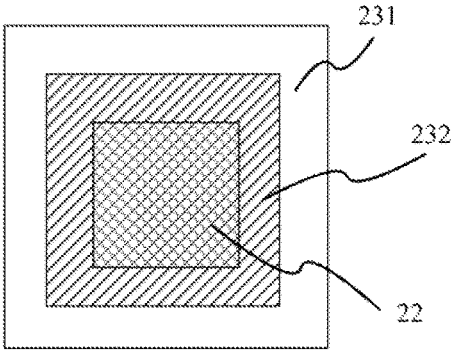
FIGS. 2*c*-2*f* specifically show the cross-sectional front views of the passive radiator combined with the transducer in FIG. 2*a* according to different embodiments.

It is noted that the shapes of the front cross sections of a transducer 22 and a passive radiator 23 are not limited to disks as shown in FIGS. 1*b* and 2*b*. Here, for the purpose of simplification, only the cross-sectional front views of the passive radiator 23 combined with the transducer 22 are shown in the following FIGS. 2*c*-2*f*. For example, FIG. 2*c* shows an exemplary cross-sectional front view of the passive radiator 23 combined with the transducer 22 in FIG. 2*a*. As shown in FIG. 2*c*, the shapes of the front cross sections of the transducer 22 and the passive radiator 23 are both squares.

Figure 2D:
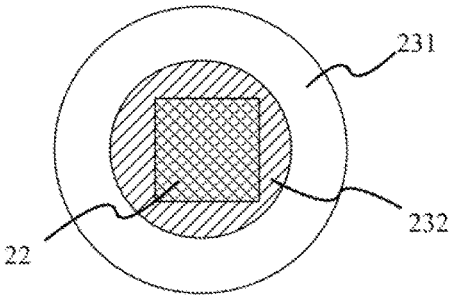

Furthermore, the shapes of the front cross sections of a transducer and a passive radiator may be different from each other. For example, FIG. 2*d* shows another exemplary cross-sectional front view of the passive radiator 23 combined with the transducer 22 in FIG. 2*a*. As shown in FIG. 2*d*, the shape of the front cross section of the transducer 22 is a square and that of the passive radiator 23 is a disk. Apparently, the contrary case is possible. The cases shown in FIGS. 2*b*-2*d* are only exemplary, and the shapes of the front cross sections of a transducer and a passive radiator may be any shapes and may be the same or different from each other.

Figure 2E:
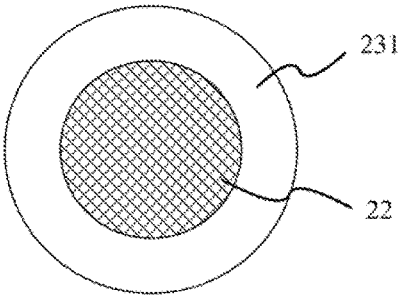
Figure 2F:
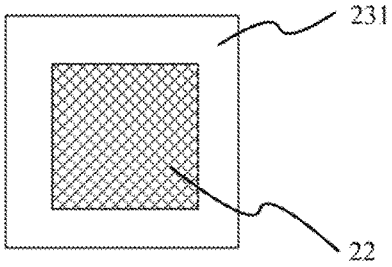

Additionally, although FIG. 2*b*-2*d* shows the cases that the transducer 22 partly replaces the center panel 232 of the passive radiator 23, the present disclosure is not limited to those cases. The transducer 22 may fully replace the center panel 232 of the passive radiator 23. FIGS. 2*e* and 2*f* respectively show the cross-sectional front views of the passive radiator 23 combined with the transducer 22 in FIG. 2*a* in cases that the transducer 22 fully replaces the center panel 232 of the passive radiator 23. FIG. 2*e* corresponds to a case that the shapes of the front cross sections of the transducer 22 and the center panel 232 are both disks, while FIG. 2*f* corresponds to a case that the shapes of the front cross sections of the transducer 22 and the center panel 232 are both squares. As shown in FIGS. 2*e* and 2*f*, the transducer 22 functions as the whole center panel 232 of the passive radiator 23, that is, the transducer 22 is directly encircled by and adhered to the suspension 231 of the passive radiator 23. In this way, the cost of the speaker may be further saved.

Figure 3A:
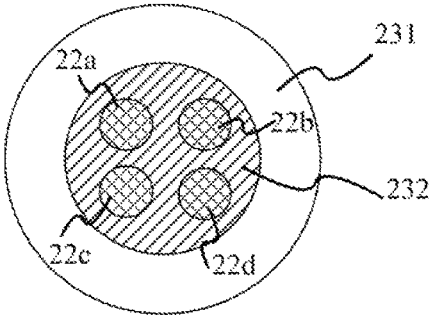
FIGS. 3*a*-3*d* specifically show the cross-sectional front views of the passive radiator combined with four transducers according to different embodiments.
Figure 3B:
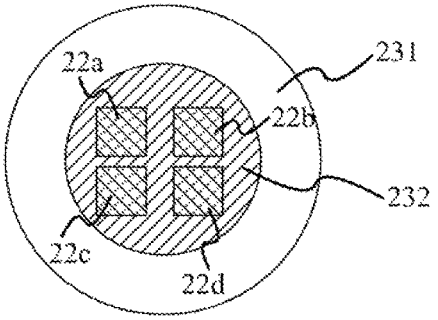
Figure 3C:
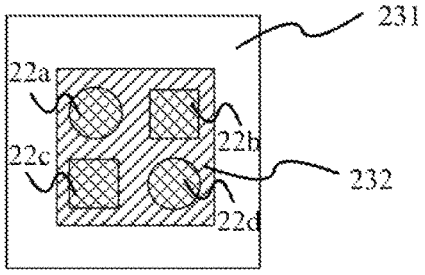

FIGS. 2*a*-2*f* corresponds to a speaker containing only one transducer. However, in some cases, a speaker may contain multiple transducers. Now, taking four transducers as an example, the description is made to cases that multiple transducers partly or fully replace the center panel of a passive radiator. FIGS. 3*a*-3*d* respectively shows the cross-sectional front views of the passive radiator 23 combined with four transducers 22*a*-22*d*. As shown in FIG. 3*a*, the four transducers 22*a*-22*d* each replaces a part of the center panel 232 of the passive radiator 23. That is, the four transducers 22*a*-22*d* are each encircled by and adhered to the center panel 232 of the passive radiator 23. Similarly, the shapes of the front cross sections of the four transducers and the passive radiator may be the same or different. For example, FIG. 3*a* corresponds to a case that the shapes of the front cross sections of the four transducers and the passive radiator are both disks, while FIG. 3*b* corresponds to a case that the shapes of the front cross sections of the four transducers are squares and that of the passive radiator is a disk. Further, the shapes of the front cross sections of the four transducers may be different from each other. For example, FIG. 3*c* shows a case that the shapes of the front cross sections of the transducers 22*a* and 22*d* are disks while those of the transducers 22*b* and 22*c* are squares.

Figure 3D:
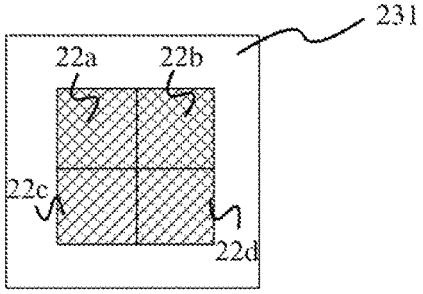

Similarly with the cases of containing only one transducer, the center panel 232 of the passive radiator 23 may be fully replaced by the four transducers 22*a*-22*d*, as shown in FIG. 3*d*. In this case, the four transducers 22*a*-22*d* are adhered to each other and all of them are directly encircled by and adhered to the suspension 231 of the passive radiator 23.

Although the center panel 232 of the passive radiator 23 is fully or partly replaced by all of four transducers 22*a*-22*d* as shown in FIG. 3*a*-3*d*, the present disclosure is not limited thereto. Apparently, although not shown, only a part of the four transducers 22*a*-22*d*, such as one, two, or three, may be used to fully or partly replace the center panel 232 of the passive radiator 23 while the others, for example the other three, two, or one of the four transducers 22*a*-22*d* may be mounted separately in the enclosure and operate respectively as a prior transducer.

As an example of a speaker containing multiple transducers, FIGS. 3*a*-3*d* show cases that there are four transducers in a speaker. However, the number of the transducers contained in a speaker is not limited to four and may be two, three, five or even more depending on requirements.

It is appreciated by those skilled in the art that, although the shapes of transducers and the passive radiator are shown as disks or squares in FIGS. 2*b*-2*f* and FIGS. 3*a*-3*d*, the present disclosure is not limited thereto, and the shapes of transducers and the passive radiator may be any one of the follows: disk, ellipse, diamond, square, triangle, or any combination thereof.

Although the above description relates to cases that there is only one passive radiator in a speaker, the present disclosure is not limited thereto, and a speaker may have multiple passive radiators mounted therein. Similarly, the center panel of one, some or all of the multiple passive radiators in a speaker can be fully or partly replaced by one or more transducer(s).

Figure 4:
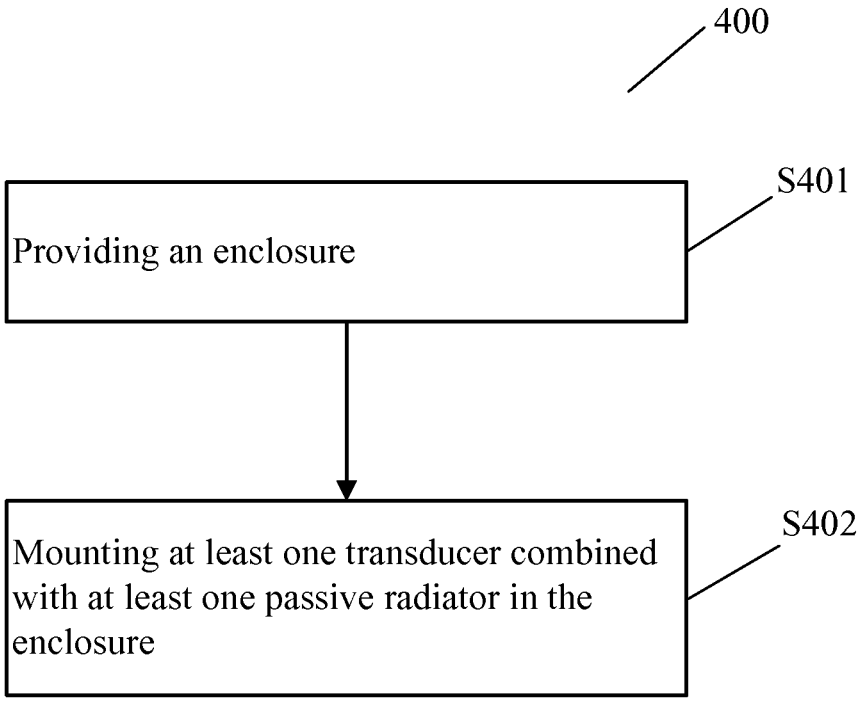
FIG. 4 shows a flowchart for a method of producing a speaker according to an embodiment of the present disclosure.

FIG. 4 shows a flowchart for a method 400 of producing a speaker according to an embodiment of the present. At step S401, an enclosure is provided. At step S402, at least one transducer combined with at least one passive radiator is mounted in the enclosure. In the present disclosure, the at least one passive radiator comprises a suspension and a center panel, the center panel is connected with the suspension, and it is encircled by the suspension, and the at least one transducer functions as at least a part of the center panel.

According to an embodiment of the present disclosure, the center panel of the at least one passive radiator is fully replaced by the at least one transducer. In such a case, each of the at least one passive radiator comprises only a suspension without any center panel as described above, and the at least one transducer, functioning as the center panel as described above, is directly connected with and encircled by the suspension. For example, FIG. 2*e* and FIG. 2*f* respectively show the cross-sectional front views of the passive radiator 23 combined with the transducer 22 in case that the transducer 22 fully replaces the center panel 232 of the passive radiator 23. In the case of FIG. 2*e* and FIG. 2*f*, there are only the transducer 22 combined with the suspension 231 of the passive radiator 23 without the center panel at all.

Therefore, according to the present disclosure, a speaker comprises: an enclosure; at least one transducer mounted in the enclosure; and at least one passive radiator mounted in the enclosure, comprising a suspension and a center panel encircled by and adhered to the suspension, wherein the at least one transducer is mounted on the at least one passive radiator, and functions as at least a part of the center panel.

According to the present disclosure, a speaker comprises: an enclosure; at least one passive radiator mounted in the enclosure, each of the at least one passive radiator comprising a suspension; and at least one transducer combined with the at least one passive radiator in a way of being connected to and encircled by the suspension.

According to the present disclosure, the at least one transducer partly replaces the center panel. According to the present disclosure, the at least one transducer fully replaces the whole center panel. According to the present disclosure, the at least one transducer is mounted on the at least one passive radiator in a way of locating within the enclosure. According to the present disclosure, the at least one transducer is combined with the at least one passive radiator in any way of the follows: adhering, riveting, crimping, and bolting. According to the present disclosure, the shapes of the at least one transducer and the at least one passive radiator is any one of the follows: disk, ellipse, diamond, square, triangle, any irregular shape, or any combination thereof. According to the present disclosure, the numbers of the at least one transducer and the at least one passive radiator are natural numbers equal to or more than one.

According to the present disclosure, a method of producing a speaker comprises steps of: providing an enclosure; and mounting at least one transducer combined with at least one passive radiator in the enclosure, wherein the at least one passive radiator comprises a suspension and a center panel connected with and encircled by the suspension, and the at least one transducer functions as at least a part of the center panel.

According to the present disclosure, the method further comprises a step of replacing the center panel partly by the at least one transducer. According to the present disclosure, the method further comprises a step of replacing the whole center panel fully by the at least one transducer. According to the present disclosure, the method further comprises a step of mounting the at least one transducer on the at least one passive radiator in a way of locating within the enclosure. According to the present disclosure, the method further comprises a step of combining the at least one transducer with the at least one passive radiator in any way of the follows: adhering, riveting, crimping, and bolting. According to the present disclosure, the shapes of the at least one transducer and the at least one passive radiator are any one of the follows: disk, ellipse, diamond, square, triangle, any irregular shape, or any combination thereof. According to the present disclosure, the numbers of the at least one transducer and the at least one passive radiator are natural numbers equal to or more than one.

According to the present disclosure, a method of producing a speaker comprises steps of: providing an enclosure; mounting at least one transducer combined with at least one passive radiator in the enclosure, wherein each of the at least one passive radiator comprises a suspension, and the at least one transducer is connected with and encircled by the suspension.

Similarly with the speaker as described above, according to the above method for speaker production, by fully or partly replacing the center panel of the at least one passive radiator by one or more transducer(s), both the internal space and the cost of the speaker are saved without sacrificing the sound quality.

To sum up, no matter how many transducers and passive radiators are included and no matter what the shapes of the front cross sections of transducers and the passive radiators are respectively, the effect of saving the internal space and the cost of the speaker without sacrificing the sound quality will be achieved as long as the center panel of at least one of the passive radiators is partly or fully replaced by one or more transducer(s), that is, at least one transducer functions as at least a part of the center panel of the at least one of the passive radiators.

In addition, although not shown, the speaker according to the present disclosure, may have a structure mounted on its back side of the enclosure (which is opposite to the side mounted with transducer) to guarantee that the enclosure can be fixed on some kinds of supportive structure, such as but not limited to vehicle inside wall.

While various aspects and embodiments have been described herein, other aspects and embodiments will be apparent to those skilled in the art. The various aspects and embodiments described herein are for purposes of only illustration and are not intended to be limiting, with the true scope and spirit being indicated by the following claims.

What is claimed is:

1. A speaker, comprising:

an enclosure;

a plurality of transducers mounted in the enclosure; and a passive radiator mounted in the enclosure, comprising a suspension and a center panel encircled by and connected to the suspension, wherein the plurality of transducers is combined with the passive radiator, and the plurality of transducers is encircled by the suspension of the passive radiator, wherein the plurality of transducers fully replaces the center panel in its entirety of the passive radiator.

2. The speaker of claim 1, wherein the plurality of transducers is mounted on the passive radiator in a way of locating within the enclosure.

3. The speaker of claim 1, wherein the plurality of transducers is combined with the passive radiator in any way of the following: adhering, riveting, crimping, and bolting.

4. The speaker of claim 1, wherein a shape of one of the plurality of transducers and the passive radiator is any one of the following: a disk, an ellipse, a diamond, a square, a triangle, and any irregular shape.

5. The speaker of claim 1, further comprising at least one transducer mounted in the enclosure and separately from the passive radiator.

6. The speaker of claim 1, wherein the plurality of transducers is combined with the passive radiator in a way of being directly connected to and encircled by the suspension.

7. The speaker of claim 1 wherein the plurality of transducers functions as at least a part of the center panel when the plurality of transducers is combined with the passive radiator.

8. A method of producing a speaker, comprising steps of:

providing an enclosure; and mounting a plurality of transducers combined with a passive radiator in the enclosure, wherein the passive radiator comprises a suspension and a center panel connected with and encircled by the suspension, and the plurality of transducers is encircled by the suspension of the passive radiator, and wherein the plurality of transducers fully replaces the center panel in its entirety of the passive radiator.

9. The method of claim 8, wherein the plurality of transducers functions as at least a part of the center panel when the plurality of transducers is combined with the passive radiator.

10. The method of claim 8, further comprising combining the plurality of transducers with the passive radiator in any way of the following: adhering, riveting, crimping, and bolting.

11. The method of claim 8, wherein a shape of one of the plurality of transducers and the passive radiator is any one of the following: a disk, an ellipse, a diamond, a square, a triangle, and any irregular shape.

12. The method of claim 8, wherein the plurality of transducers is combined with the passive radiator in a way of being directly connected to and encircled by the suspension.

* * * * *